United States Patent [19]

Schmidt

[11] Patent Number: 4,716,917

[45] Date of Patent: Jan. 5, 1988

[54] TANK WASHING SYSTEM

[76] Inventor: Ernst L. Schmidt, Wetstraat 112, Antwerpen, Belgium, B-2008

[21] Appl. No.: 881,275

[22] Filed: Jul. 2, 1986

[30] Foreign Application Priority Data

Jul. 8, 1985 [SE] Sweden ..... 8503383

[51] Int. Cl.[4] ..... B08B 3/02; B08B 9/08

[52] U.S. Cl. ..... 134/167 R; 134/181; 239/227

[58] Field of Search ..... 134/167 R, 168 R, 180, 134/181; 239/227, 243

[56] References Cited

U.S. PATENT DOCUMENTS

| | | | |
|---|---|---|---|
| 2,610,088 | 9/1952 | Randell | 239/227 X |
| 3,140,828 | 7/1964 | Galanor | 239/227 |
| 3,182,669 | 5/1965 | Campbell et al. | 134/167 R X |
| 3,595,256 | 7/1971 | Waltman et al. | 239/227 X |

FOREIGN PATENT DOCUMENTS

| | | |
|---|---|---|
| 2207191 | 1/1976 | Fed. Rep. of Germany . |
| 1811719 | 2/1980 | Fed. Rep. of Germany . |
| 307719 | 1/1969 | Sweden . |
| 8202418-3 | 4/1982 | Sweden . |

*Primary Examiner*—Philip R. Coe
*Attorney, Agent, or Firm*—Bacon & Thomas

[57] ABSTRACT

This invention relates to a washing system for washing tanks or the like, preferably ship's tanks (2) having one or more substantially horizontal stringers (2*a*–2*c*), the washing system (1) being provided with washing nozzles which while rotating about a substantially vertical axis are at the same time rotatable about substantially horizontal axes. In order that this washing system (1) shall provide effective cleaning of various nooks and recesses in the tank (2), the washing system comprises nozzle holders (9, 24 or 9, 9*a*, 24) arranged at various elevations, each of said nozzle holders having at least one washing nozzle (11, 25 or 11, 19, 25). An upper nozzle holder (9) at an upper elevation is detachably disposed on a standpipe (3) connected to the tank (2). An extension pipe (21 or 16, 21) is detachably and non-rotatably coupled to the upper nozzle holder (9) via a coupling (17). A lower nozzle holder (24) at a lower elevation is coupled to the extension pipe (16 or 16, 21) via a coupling (23). A rotary and vertically reciprocatory drive member (13) is adapted, on the one hand, to rotate the upper nozzle holder (9) and the extension pipe (21 or 16, 21) non-rotatably mounted on the holder about a substantially vertical axis and, on the other hand, simultaneously to rotate the washing nozzles (11, 25 or 11, 19, 25). The drive member (13) has an upper portion (13*a*) extending through the standpipe (13) on which portion a drive member extension (20*a* or 20, 20*a*) is detachably mounted (FIG. 1).

8 Claims, 5 Drawing Figures

TANK WASHING SYSTEM

This invention relates to a system for washing tanks or the like, preferably ship's tanks having one or more substantially horizontal stringers, said washing system being provided with washing nozzles which while rotating about a vertical axis are at the same time rotatable about horizontal axes.

Washing systems of the type referred to are disclosed by for instance SE-A-8202418-3, SE-B-307 719 and DE-B-22 07 191. A drawback inherent in these prior-art washing systems is, however, that they do not reach into all nooks and recesses of such tanks as have stringers and frames of various configuration. It is particularly difficult to clean such ship's tanks as have, for reinforcing purposes, several, e.g. three, horizontal stringers and several, e.g. two, vertical frames with apertures therein. In such a tank the washing systems of the type referred to cannot wash clean all nooks and recesses above or below the stringers or behind the frames.

U.S. Pat. No. 3,140,828 discloses a washing system provided with a plurality of sets of washing nozzles at various elevations. These washing nozzles, however, are driven by the reaction forces generated by the washing jets, and it is not possible to cause the washing nozzles to sweep over a limited sector for cleaning of a defined portion of the tank. Besides the reaction forces of the washing jets will accelerate the washing nozzles to uncontrollable speeds, which implies the risk of damage to the movable parts. Furthermore, this prior-art washing system involves high manufacturing costs as it is costly to provide vertical pipes with a horizontal pipe branch for each nozzle.

Finally DE-B-22 07 191 describes and shows a washing system whose washing nozzles are certainly controlled by an inner drive, but no rotary movement is imparted to the pipe on which the washing nozzles are arranged, which implies that the system is not suited to carry out an effective tank cleaning.

One object of the present invention is to provide a washing system which is capable of carrying out an effective cleaning of tanks even if they have various, customarily difficult-to-clean pockets.

Another object of the invention is that the washing system shall be easy to mount and dismount and that it shall comprise as few and simple parts as possible.

These objects are mainly realized in that the washing system has been given the characteristic features appearing from appendant claim 1.

The washing system according to the invention can be adapted for an effective cleaning av tanks having difficult-to-clean pockets, it can be controlled so as to subject certain spaces of the tank to a particularly effective washing, it is robust and simple, it comprises but a small number of parts, it is simple to mount and dismount, and the parts provided with the washing nozzles are small and easily handled.

The invention is elucidated more in detail below, with reference to the accompanying drawings in which.

Figure 1:
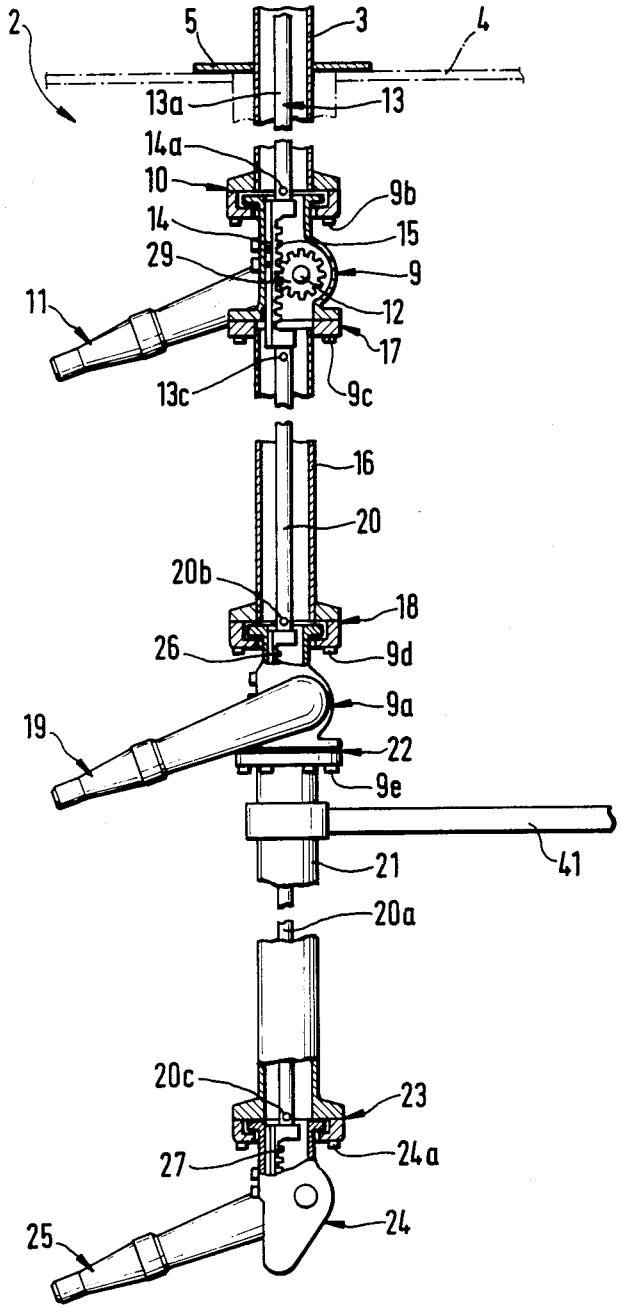
FIG. 1 illustrates a washing assembly according to the invention certain parts of the assembly being shown in section.
Figure 2:
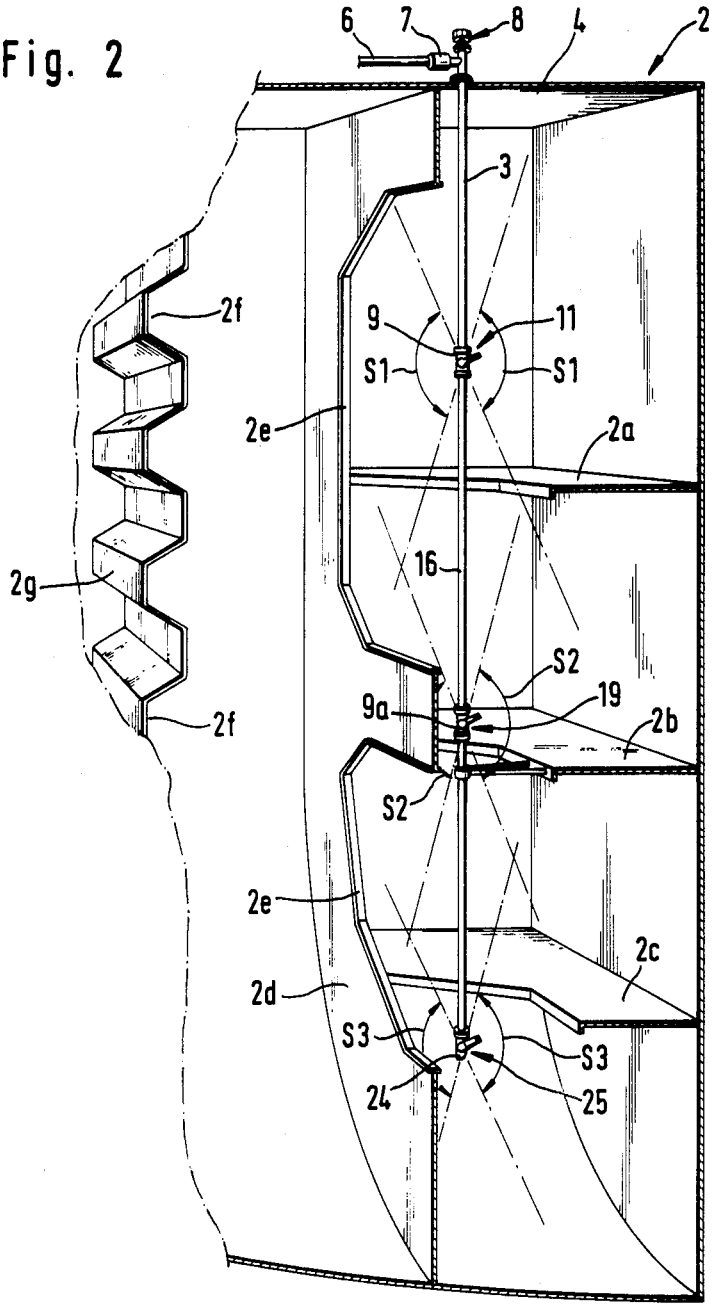
FIG. 2 illustrates two washing assemblies according to FIG. 1 arranged in a ship's tank.
Figure 3:
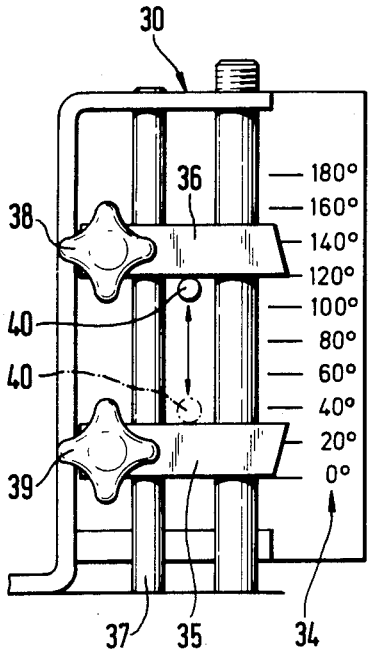
FIG. 3 illustrates a device for setting the washing sector of the washing nozzles in the washing assembly according to the invention.
Figure 4:
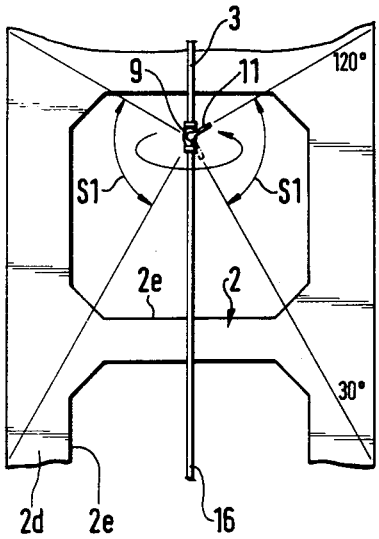
Figure 5:
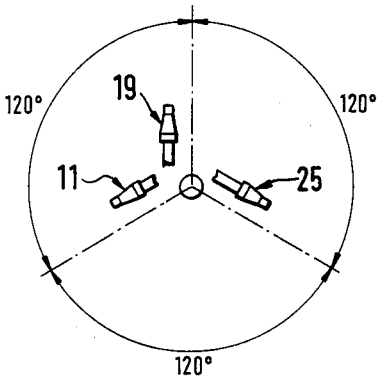

FIG. 4 diagrammatically illustrates within which washing sector the washing nozzles move at the setting shown in FIG. 3; and FIG. 5 diagrammatically illustrates how the washing nozzles of the washing assembly may be directed.

The washing assembly 1 illustrated in the drawings is intended for the washing of a ship's tank 2 which has three substantially horizontally directed stringers 2*a*, 2*b* and 2*c* and a substantially vertically directed frame 2*d*. The washing assembly 1 comprises a standpipe 3 which is arranged on the deck 4 of the ship by means of a fastening flange 5 and a bolt screwing-connection. To the standpipe 3 there is connected a conduit 6 to conduct washing liquid in the form of water or a mixture of water and a detergent to the standpipe 3. The conduit 6 is provided with a valve 7 for shutting off or controlling the supply of washing liquid. The standpipe 3 further has a drive 8 of a type known in and per se which serves to rotate nozzle holders and washing nozzles mounted thereon. An upper nozzle holder 9 is detachably mounted by means of a bolt screwing-connection 9*b* to the lower part of the stand-pipe 3 via a pivot bearing 10 in such a way that the nozzle holder 9 is able to rotate about a substantially vertical axis in relation to the standpipe 3. On the nozzle holder 9 there is pivotally mounted an upper washing nozzle 11 by means of a pivot bearing 12 in such a way that the washing nozzle 11 will rotate about a substantially horizontal axis in relation to the nozzle holder 9. The upper nozzle holder 9 and its upper washing nozzle 11 are placed at an elevation above the upper stringer 2*a* in order that this washing nozzle 11 shall be able to wash the tank clean mainly above the stringer 2*a*.

An intermediate portion 16 of an extension pipe 16, 21 is disposed on the lower part of the upper nozzle holder 9 via a coupling 17 and detachably and non-rotatably mounted to said part by means of a bolt screwing-connection 9*c*, which implies that the upper nozzle holder 9 and the intermediate portion 16 will rotate together. An intermediate nozzle holder 9*a* is disposed on the lower part of the portion 16 via a coupling 18 and detachably and non-rotatably mounted to said lower part by means of a bolt screwing-connection 9*a*, implying that the intermediate nozzle holder 9*a* will rotate together with the portion 16 of the extension pipe 16, 21.

On the intermediate nozzle holder 9*a* there is disposed an intermediate washing nozzle 19 which like the upper washing nozzle 11 is mounted in a pivot bearing to be able to rotate about a substantially horizontal axis.

The intermediate nozzle holder 9*a* and its washing nozzle 19 are disposed at an elevation slightly above the intermediate stringer 2*b* to deliver with the aid of said washing nozzle 19 a washing jet for cleaning substantially the tank space above said stringer 2*a*, but also for cleaning the portions of a tank space between the intermediate stringer 2*b* and the lower stringer 2*c*.

A lower portion 21 of the extension pipe 16, 21 is disposed on the lower part of the intermediate nozzle holder 9*a* via a coupling 22 and detachably and non-rotatably mounted to said lower part of the nozzle holder 9*a* by means of a bolt screwing-connection 9*e*, whereby said lower portion 21 of the extension pipe 16, 21 rotates together with the intermediate nozzle holder 9*a*.

A lower nozzle holder 24 with a lower washing nozzle 25 which is rotatable about a substantially horizontal axis in the same way as the other washing nozzles 11, 19, is disposed down on the lower portion 21 of the extension pipe 16, 21 via a coupling 23 and detachably and non-rotatably mounted to said lower portion 21 by means of a bolt screwing-connection *24a.*

The lower nozzle holder 24 and its washing nozzle are located below the upper stringer *2a* whereby the washing jet delivered by the washing nozzle 25 washes clean substantially the tank space below the upper stringer *2a,* i.e. the usually highly tank soil contaminated bottom region of the tank. Besides the washing jet of the lower washing nozzle 25 can reach into the space between the intermediate stringer *2b* and the lower stringer *2c* to clean such portions of said space as are not reached by the jet delivered by the intermediate washing nozzle 19.

For rotation of the nozzle holders 9, *9a* and 24 as well as the extension pipe 16, 21 about a substantially vertical axis the drive 8 comprises a drive member 13 which is rotated by the drive 8 and the upper part *13a* of which extends down through the standpipe 3 to the level of the upper nozzle holder 9. To the lower end of the upper part *13a* of the drive member and to the upper parts of the nozzle holder 9 there is detachably and non-rotatably mounted a rack 15 with a longitudinal groove (not shown) therein, via a bolt *13b* or the like.

A dog 14 fixed to the nozzle holder 9 by means of bolts *14a* engages the longitudinal groove in said rack 15 in such a way that the rotary movement of the rack 15 about the vertical axis is transmitted via said dog 14 to the nozzle holder 9, and furthermore the rack 15 is above to move vertically in relation to the dog 14 and thus in relation to the nozzle holder 9. An upper portion 20 of the drive member extension 20, *20a* is mounted in a detachable and non-rotatable manner to the lower end of the rack 15 and the lower portions of the nozzle holder 9 by means of a bolt *13c.* Said upper portion 20 extends through the intermediate portion 16 of the extension pipe 16, 21, and a rack 26 which is preferably of the same configuration as the rack 15 is mounted to the lower end of said portion 20 and to the upper parts of the intermediate nozzle holder *9a* in a detachable and non-rotatable manner via a bolt *20b.* The rack 26 like the rack 15 has a longitudinal groove (not shown) in which engages a dog (not shown) of the same type and function as the dog 14. At the lower end of the rack 26 and on a level with the lower end of the intermediate nozzle holder *9a* a lower portion *20a* of the drive member extension 20, *20a* is detachably and non-rotatably mounted by means of a bolt (not shown). Said lower portion *20a* of the drive member extension 20, *20a* passes through the lower portion 21 of the extension pipe 16, 21 approximately to the level of the upper parts of the lower nozzle holder 24. A rack 27 is detachably and non-rotatably mounted to the lower end of the lower portion *20a* of the drive member extension 20, *20a* by means of a bolt *20b* and extends down in the lower nozzle holder 24. The rack 27 has the same function as the racks 15 and 26 and like these cooperates with a dog (not shown) which allows the rack to move vertically in relation to the lower nozzle holder 24.

Each nozzle holder 9, *9a* and 24 has a pivot bearing 12 in which the inner parts of the respective washing nozzle 11 and 19 and 25, respectively, are pivotally mounted. On each inner part there is mounted a gear 29 cooperating with the respective rack 15, 26 and 27.

In addition to causing all parts of the washing assembly below the standpipe 3 to rotate about a substantially vertical axis, the drive 8 imparts alternating up and down movements to the drive member 13 and its extensions 20, *20a.* As the racks 15, 26, 27 cooperate with the gears 29 of the washing nozzles 11, 19, 25 said up and down movements will synchronously cause all washing nozzles 11, 19, 25 to rotate about substantially horizontal axes.

On the drive 8 there is preferably arranged a setting device 30 (see FIG. 3) for setting the position and size of the sectors S1, S2, S3 of the tank 2 that each washing nozzle 11, 19, 25 is to wash. Fundamentally, the setting device 30 has a graduation of 0°–180°. Two abutments 35, 36 disposed on a stay 37 are movable along said graduation 34 and provided with screws 38, 39 for arresting the abutments 35, 36 in suitable positions on the stay 37.

A pin 40 cooperating with the drive member 13 and partaking in the up and down movement thereof engages between the abutments 35, 36 such that the upward movement of the pin 40, i.e. also that of the drive member 13, is stopped by the upper abutment 36 while the downward movement of the pin 40, i.e. also that of the drive member 13, is stopped by the lower abutment 35. At the illustrated setting of the setting device 30 the lower abutment 35 points to 30° while the upper abutment 36 points to 120°. This means that the washing nozzles 11, 19, 25 wash sectors S1, S2, S3 which begin down at 30° relative to the vertical and at the top end when the sectors S1, S2 and S3 have reached 120° from their lower starting line. By adjustment of the abutments 35, 36 a suitable position between 0° and 180° relative to the vertical and also a suitable size of the sectors S1–S3 can be set.

Being tubular, the nozzle holders 9 and *9a* simultaneously constitute washing liquid conduits between the pipes 3, 16 and 21 If the tank 2 has a frame *2d* with apertures *2e,* the washing assembly 1 is preferably placed in the vicinity of said frame *2d,* and the washing nozzles 11, 19, 25 in such a way in relation to the apertures *2e* that also the space on the other side of the frame *2d* is washed clean. If the tank 2 has corrugated-type walls *2g* with pockets *2f,* the nozzles 11, 19 and 25 are so placed as to wash clean also such pockets *2f.*

The upper and intermediate nozzle holders 9 and *9a,* respectively preferably have the same shape and the racks 15, 26 (or corresponding means) provided therein may also have the same shape. Besides the racks 15, 26 may be approximately as long as the respective nozzle holder 9 and *9a.* Anyone of the nozzle holders 9, *9a* or 24 may be connectable to the standpipe 3, that is to say that the washing assembly may be varied as regards its length and the number of washing nozzles. The washing assembly 1 can thus possess three washing nozzles 11, 19, 25 as shown in the drawings or the two washing nozzles 11 and 25 only. In that case, the nozzle holder *9a,* the extension pipe portion 21 and corresponding drive member portions 20, *20a* are dispensed with and the nozzle holder 24 is connected to the extension pipe portion 16 and the rack 27 to the portion 20 of the drive member. It is also possible, in certain cases, to dispense with the two washing nozzles 11 and 19, using only the washing nozzle 25. In doing so, the nozzle holders 9 and *9a,* the extension pipe portions 16 and 21 and the drive member portions 15, 20, 26 and *20a* are dispensed with and the nozzle holder 24 is connected directly to the standpipe 3 and the rack 27 directly to the drive member portion 13*a*. The number of washing nozzles may also be greater than three washing nozzles at various elevations, and each nozzle holder may comprise more than one washing nozzle. The washing assembly 1 illustrated, as a result, will be very flexible with regard to size and possibilities of adaption to ship's tanks or like spaces whether they lack stringers, frames, pockets or the like, or have stringers, frames or pockets or are difficult to clean for other reasons.

In the embodiment illustrated the nozzle holders 9, 9*a* and 24 are essentially shorter than each extension pipe portion 16, 21. This is advantageous because short nozzle holders 9, 9*a* and 24 are easier to transport, to store in a well packaged state and to mount than elongated ones. The extension pipe portions 16, 21 are preferably uniform; however, they may of different lengths.

As shown in FIG. 5 the washing nozzles 11, 19, 25 may, if desired, be directed in different directions—as seen downward from the standpipe 3—to balance the reaction forces generated by the washing liquid, the washing nozzles 11, 19, 25 being so arranged that their washing jets are delivered in directions relatively offset by 120°. To counteract oscillations of the extension pipe 16 or 16,21 said pipe may cooperate with a support 41 which is preferably disposed on one of the stringers 2*a*–2*c*, if such stringers are provided.

The washing system illustrated is applicable not only to large ship's tanks but also to the washing of other kinds of tanks or cisterns, and the various parts of the system may be of any other configuration than that illustrated.

I claim:

1. A washing system for washing tanks or the like, preferably ship's tanks (2), having at least one substantially horizontally extending stringer (2*a*–2*c*), said washing system (1) being provided with washing nozzles which while rotating about a substantially vertical axis are at the same time rotatable about substantially horizontal axes, characterized in that the washing system (1) comprises nozzle holders (9, 24 or 9, 9*a*, 24) arranged at at least two different elevations, each of said nozzle holders having at least one washing nozzle (11, 25 or 11, 19, 25), that an upper nozzle holder (9) at an upper elevation is detachably disposed by means of a pivot bearing (10) on a standpipe (3) connected to the tank (2), that at least one extension pipe (21 or 16, 21) is detachably and non-rotatably coupled to the upper nozzle holder (9) via a coupling (17), that the upper nozzle holder (9) is tubular to conduct washing liquid from the standpipe (3) to the extension pipe (21 or 16, 21), that a lower nozzle holder (24) at a lower elevation is detachably and non-rotatably coupled to the extension pipe (21 or 16, 21) via a coupling (23,) that a rotary and vertically reciprocable drive member (13) is adapted, on the one hand, to rotate the upper nozzle holder (9) and the extension pipe (21 or 16, 21) non-rotatably mounted on said holder (9) about a substantially vertical axis and, on the other hand, simultaneously to rotate the washing nozzles (11, 25 or 11, 19, 25) in synchronism about substantially horizontal axes in relation to the nozzle holders (9, 24 or 9, 9*a*, 24), that the drive member (13) has an upper portion (13*a*) extending through the standpipe (3) on which portion a drive member extension (20*a* or 20, 20*a*) is detachably mounted to at least the upper nozzle holder (9), the washing nozzle (25) of the lower nozzle holder (24) being located in the vicinity of the bottom of the tank (2) in order primarily to wash said bottom and the lower portions of the tank (2), while the upper washing nozzle (11) is located on an essentially higher level of the tank (2) in order primarily to wash the upper portions of the tank (2) and possibly such portions as are concealed to washing with the lower washing nozzle (24).

2. A washing system as claimed in claim 1, characterized in that the upper nozzle holder (9) with the upper washing nozzle (11) is located at an elevation above the at least one substantially horizontally extending stringer (2*a* and/or 2*b* and/or 2*c*), the upper nozzle (11) being controlled by reciprocating movement of the drive member (13) so as to rotate back and forth in a substantially vertical direction within a limited washing sector (S1), while the lower nozzle holder (24) with the lower washing nozzle (25) is located at an elevation below the at least one substantially horizontally extending stinger (2*a* and/or 2*b* and/or 2*c*), the lower washing nozzle (24) being controlled by reciprocating movement of the drive member extension (20 or 20, 20*a*) so as to rotate in a substantially vertical direction within another limited washing sector (S3).

3. A washing system as claimed in claim 1, characterized in that it comprises at least three nozzle holders (9, 9*a* and 24) each of said nozzle holders having a washing nozzle (11, 19 and 25), which holders are located at at least three different elevations, an intermediate nozzle holder (9*a*) being situated at an elevation between upper and lower nozzle holders (9, 24) and detachably and non-rotably mounted to an intermediate portion (16) of the extension pipe (16, 21) via a coupling (18), a lower portion (21) of the extension pipe (16, 21) being detachably and non-rotatably mounted on the intermediate nozzle holder (9*a*) via a coupling (22), said intermediate nozzle holder (9*a*) being tubular to conduct washing medium from the intermediate extension pipe (16) to the lower portion (21) of the extension pipe (16, 21), that an upper portion (20) of the drive member extension (20, 20*a*) is detachably mounted on the upper drive member portion (13*a*) and that the intermediate nozzle holder (9*a*) is detachably connected to a lower portion (20*a*) of the drive member extension (20, 20*a*).

4. A washing system as claimed in claim 3, in which the tank (2) comprises at least three substantially horizontally extending stringers (2*a*, 2*b* and 2*c*), characterized in that the upper nozzle holder (9) and its washing nozzle (11) are located at an elevation above an upper stringer (2*a*), that the intermediate nozzle holder (9*a*) and its nozzle (19) are located at an elevation between the upper stringer (2*a*) and an intermediate stringer (2*b*), and that the lower nozzle holder (24) and its nozzle (25) are disposed below a lower stringer (2*c*) or approximately on a level therewith, the washing nozzles (11, 19 and 25) at all three elevations being driven in synchronism and the upper nozzle (11) being controlled by the reciprocatory movement of the drive member (13) so as to rotate back and forth in substantially vertical direction to wash a sector (S1) of the tank (2) which is situated substantially above the upper stringer (2*a*), the intermediate nozzle (19) being controlled so as to rotate in order to wash a sector (S2) of the tank (2) which is situated substantially above the intermediate stringer (2*b*) and also below said stringer (2*b*) and the lower washing nozzle (25) being controlled so as to wash a sector (S3) of the tank (2) which is situated substantially below the lower stringer (2*c*) and also above said lower stringer (2*c*).

5. A washing system as claimed in claim 1 the drive member (13) comprising parts (15, 27 or 15, 26, 27), such as racks, cooperating with the washing nozzles (11, 25 or 11, 19, 25) to rotate the washing nozzles (11, 25 or 11, 19, 25) about their substantially horizontal axes, characterized in that each part (15, 27 or 15, 26, 27) cooperating with the washing nozzles (11, 25 or 11, 19, 25), on the one hand, is approximately of the same length as a nozzle holder (9, 24 or 9, 9*a*, 24) surrounding it, and, on the other hand, is detachably and non-rotatably mounted on the lower end of a drive member portion (13*a*, 20*a* or 13*a*, 20, 20*a*) located above such part and, as the case may be, also detachably and non-rotatably mounted on the upper end of a drive member portion (20*a* or 20, 20*a*) located below such part, and that each nozzle holder (9, 24 or 9, 9*a*, 24) is essentially shorter than each extension pipe (16 or 16, 21).

6. A washing system as claimed in claim 1, when the system is comprised in a tank (2) having tially vertically extending frames (2*d*), characterized in that the washing system (1) is disposed in the vicinity of such a frame (2*c*) and that the washing nozzles (11, 25 or 11, 19, 25) direct washing jets through apertures (2*e*) of said frame (2*d*) into tank spaces situated on different sides of said frame (2*d*) and/or into various pockets (2*f*) in walls (2*g*) of the tank (2).

7. A washing system as claimed in claim 1, said system (1) comprising at least one upper, one intermediate and one lower nozzle holder (9, 9*a* and 24) as well as one intermediate and one lower extension pipe portion (16 and 21), characterized in that any one of the nozzle holders (9, 9*a* or 24) is pivotally connectably to the standpipe (3) and that the lower nozzle holder consists of a unilaterally closed pipe piece (24) while the other nozzle holders consist of identical pipe pieces (9, 9*a*) open at both ends.

8. A washing system as claimed in claim 1, characterized in that the extension pipe (16, 21) cooperates with at least one support (41).

* * * * *